United States Patent [19]

Burg

[11] 4,152,704

[45] May 1, 1979

[54] RODHOLDER MOUNTED ANTENNA

[75] Inventor: Donald E. Burg, Miami, Fla.

[73] Assignees: Gerald Buckwald; Susan Buckwald, both of Miami, Fla.

[21] Appl. No.: 843,675

[22] Filed: Oct. 19, 1977

[51] Int. Cl.[2] ..... H01Q 1/34; H01Q 1/32; H01Q 9/30; H01Q 1/50:

[52] U.S. Cl. ..... 343/709; 343/861; 343/864; 343/715; 343/720; 343/745; 343/900

[58] Field of Search ..... 343/709, 710, 711, 713, 343/715, 720, 745, 895, 900, 861, 864

[56] References Cited

U.S. PATENT DOCUMENTS

| | | | |
|---|---|---|---|
| 2,379,577 | 7/1945 | Harsted | 343/900 |
| 2,927,995 | 3/1960 | Francis | 343/900 |
| 3,474,453 | 10/1969 | Ireland | 343/745 |
| 3,774,221 | 11/1973 | Francis | 343/895 |

*Primary Examiner*—Alfred E. Smith
*Assistant Examiner*—Harry E. Barlow
*Attorney, Agent, or Firm*—Robert J. Van Der Wall

[57] ABSTRACT

A portable transceiver antenna is provided with a base suitable for retention by a fishing rodholder or for hand held use and is pretuned to facilitate its use without a ground plane. The antenna includes an electrically conductive rod which may be covered by a dielectric and segmented, and would then include couplings fabricated from ferrules closely fitted over nipples to produce reliable electrical contact through the coupling. The antenna may be used with citizens band, very high frequency - frequency modulated, and similar applications.

8 Claims, 8 Drawing Figures

RODHOLDER MOUNTED ANTENNA

BACKGROUND OF THE INVENTION

The present invention relates to the field of portable radio antennae, and, more particularly, to an antenna having a base suitable for support in a fishing rodholder or for hand held use.

In recent years there has been a steady growth in the boating accessory field, including that of two way radios. Marine two way radios, or transceivers, have sold particularly well since the Jan. 1, 1977 deadline for discontinuing use of double side band transceivers and the shift over to very high frequency - frequency modulated (hereinafter VHF) marine radios. At the same time, there has been an explosive expansion in the sales and use of citizen's band (hereinafter CB) transceivers. Particularly because of the size of the CB market, there has come, among other things, a companion increase in the market for CB accessories aimed at broadening the variety of circumstances in which the CB can be appropriately used and improving upon the utility and convenience of use. For example, CB transceivers are increasingly used in marine applications, particularly in relatively small pleasure craft and fishing boats. Moreover, because CB has a ground-wave component that causes it to follow the earth's curvature (as opposed to line-of-sight VHF), it potentially has a greater range than VHF and the use of CB in marine applications is likely to continue increasing, particularly since the recent Coast Guard announcement of its intent to monitor a CB channel.

However, with the widespread ownership and use of CB radios has come extensive and indiscriminate theft of equipment, leading many owners to mount their automobile transceivers on accessory devices for rapid removal and storage when not in use. CB transceiver antennae on automobiles also are available in models permitting removal and storage of the antenna itself, and also, sometimes of the mounting. To applicant's knowledge, there is no such removable antenna available for marine use, the closest known art being Mortensen et al, U.S. Letters Pat. No. 3,886,560, which permits a permanently mounted marine antenna to be lowered to a horizontal position. Of course, portable radios are equipped with at least one portable antenna. One such device, bearing superficial resemblance to the present invention, is described by Francis, U.S. Letters Pat. No. 2,927,955, which is a reception only radio contained in the handle of a light weight fishing rod.

In small boats, there is frequently no effective way to lock up items subject to theft, as radio equipment. One obvious solution is to utilize in boats the same type of accessory devices used to removably mount CB transceivers in automobiles. In fact, CB transceivers removably mounted in automobiles can be readily used with a similar mount on boats. But there appears to have been little attention devoted to a removable CB antenna intended primarily for general marine use, but with suitability for any portable application, such as a beach buggy, camp sites, rental outboard boats, and the like, and with a general design also appropriate to VHF use. Moreover, regardless of their purpose, most small boats, beach buggies, etc. are equipped with well known tubular fishing rodholders. Such rodholders can provide an immediate cost free appliance upon which a readily removable radio antenna can be mounted.

SUMMARY OF THE INVENTION

With the foregoing in mind, it is a principal object of the invention to provide a portable, removable transceiver antenna for marine use.

It is a further principal object of the invention to facilitate rapid and easy installation and removal of a transceiver antenna on a boat, or other supporting structure equipped with fishing rodholders.

Another object of the invention is to utilize existing fishing rodholder hardware to support an antenna that has sufficient length to maximize radio range.

A related object of the invention is to permit utilization of conventional fishing rodholers to support a radio antenna, thereby avoiding the necessity to affix specialized mounting hardware to the boat, beach buggy, etc.

A further object of the invention is to permit use of the same transceiver with different boats, beach buggies, in hand held use, and the like.

An additional object of the invention is to facilitate raising an antenna to the point of greatest height on a boat only when needed to maximize radio range.

Another object of the invention is to allow use of a directionally sensitive antenna or a high gain transceiver on a supporting structure with unstable or imporper orientation such as a heeling sailboat, a boat rolling or pitching with swells, a beach buggy parked on the side of a sand dune, etc., by permitting the antenna to be instantly converted to hand held vertical use.

A further object of the invention is to provide a durable, attractive, lightweight, low cost and conveniently stored radio antenna.

Another object is to facilitate storage of the antenna when not in actual use, to keep it out of the way when not needed, and to protect the antenna from weathering, corrosion and theft when not in use.

An additional object of the invention is to offer a pre-tuned antenna that requires no ground plane.

One more object of the invention is to provide a segmented antenna that can be readily assembled and disassembled for convenient storage, yet has the length and height in use for maximum radio range.

a related object of the invention is to offer an improved low cost coupling that allows an antenna to be of segmented construction, yet have reliable electrical contact across the coupling.

A further related object of the invention is to provide an antenna having a plurality of segments that can be employed to alter the length of the antenna for differing conditions.

One more object is to provide an antenna which is strong, resilient, lightweight, noncorrosive, economical, low maintenance, attractive, easily stored, durable, reliable and offers optimum range and performance.

These and other objects are accomplished in accordance with the broad aspects of the present invention by use of a portable transceiver antenna comprising an electrically conductive rod or wire which may be formed of a plurality of segments that have between them couplings that maintain reliable electrical connection between the segments, but allow them to be readily separated from each other for portability and storage. In the preferred embodiment, the electrically conductive rod includes a conductor with a dielectric covering and the coupling comprises male and female ferrules whose base may pass over the dielectric and are close fitted over nipples, which, in turn are in contact with the conductor.

The electrically conductive rod is mounted upon a base suitable for retention in a conventional fishing rodholder such as often already found on small boats, and the base may, in fact, be a modified fishing rod base complete with a rubber butt cap. The invention of course includes a wire for removably attaching the rod to a transceiver, normally a coaxially shielded cable with conventional PL 259 connector to mate with the transceiver chassis. Since the inventive antenna is intended for use in portable applications, it is tuned for use without the ground plane that an automobile body provides in the case of an antenna intended for automotive use. This is preferably accomplished employing a coaxial tuning stub of appropriate length connected to the wire for removably attaching the rod to the transceiver.

DESCRIPTION OF THE DRAWINGS

Turning now to the drawings.

DETAILED DESCRIPTION

Referring now to each of the foregoing Figures, a preferred and one alternative embodiment will now be described.

Figure 1:
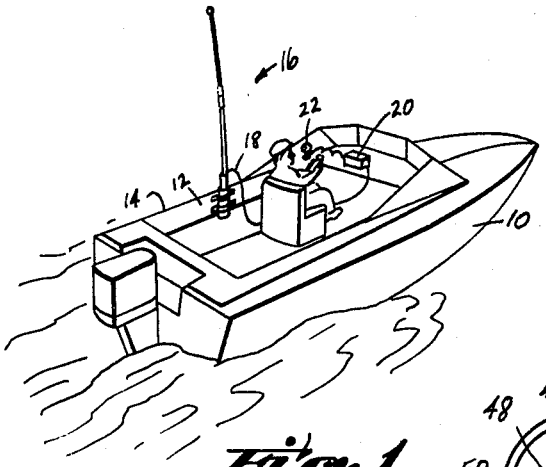
FIG. 1 is a perspective view of a typical boat using the invention.

FIG. 1 discloses a boat 10 having a conventional fishing rodholder 12 mounted to the gunwale 14, of the boat 10, and retaining the inventive portable transceiver antenna 16, and having a wire 18 for removably attaching same to a transceiver 20, having a microphone 22.

Figure 2:
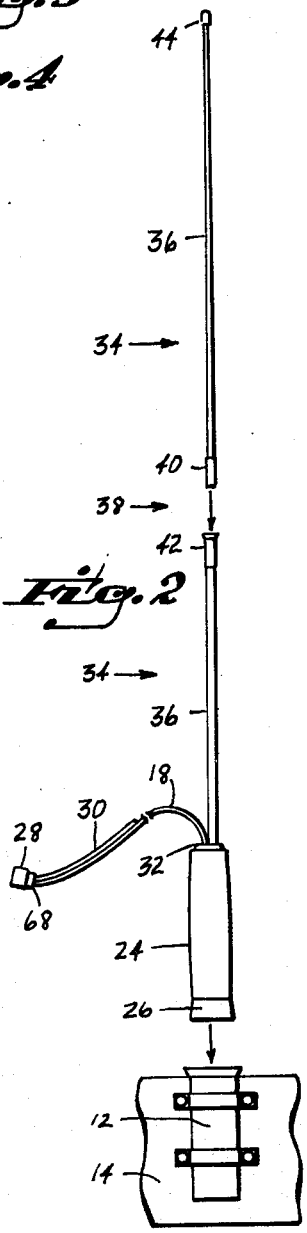
FIG. 2 is an elevation view of the invention.

FIG. 2 shows the invention in greater detail, wherein base 24 suitable for retention by a conventional fishing rodholder 12 mounted to a gunwale 14 is shown ready to drop in the rodholder 12. The base may be equipped with a friction inducing or rubber butt cap 26 and has projecting through a base collar 32 from its top the wire 18 for removably attaching the electrically conductive rod 34 to a transceiver 20 (shown only in FIG. 1). The wire 18 may include the typical PL 259 connector 28 to mate with a transceiver chassis. Also shown is tuning means 30 which is attached to the wire 18 at or near 68 the connector 28.

The electrically conductive rod 34 preferably includes a dielectric covering 36 and would generally include at least one coupling 38, preferably comprising a male ferrule 40 and a female ferrule 42. The uppermost segment of the rod 34 may include a protective and decorative peak 44.

Figure 3:
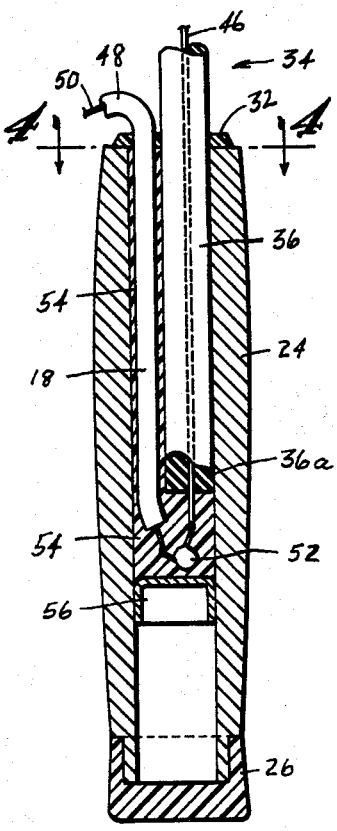
FIG. 3 is an enlarged cross-sectional elevation view through a diameter of the base.

Turning to FIG. 3, it is evident that the base 24 is hollow, with a butt cap 26 and base collar 32 on either end. Penetrating the collar 32 is the rod 34 preferably comprising a conductor 46 and dielectric covering 36 shown in cut-away cross-section at **36*a*. Preferably electrically attached to the end of conductor 46 inside of base 24 is a wire 18 for removably attaching the rod 34 to a transceiver 20 (shown only in FIG. 1), said wire 18 preferably comprising a coaxially shielded 48 cable 50. Wire 18 is ideally connected to rod 34 through a resonating capacitor 52. All interior contents of hollow base 24 are preferably immersed in a sealant 54, such as epoxy, which may be limited to the applicable area in assembly by a stopper 56**.

Figure 4:
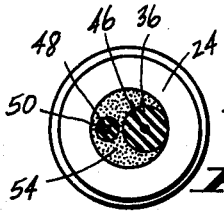
FIG. 4 is a cross-sectional plan view through the line 4—4 of FIG. 3.

In FIG. 4 is illustrated the top of the base 24 from which extends the dielectric covering 36 of the conductor 46 and the coaxial shield 48 and cable 50, all immersed in sealant 54.

Figure 5:
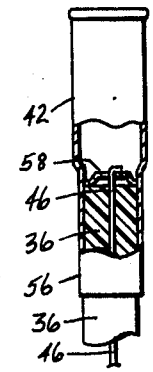
FIG. 5 is an enlarged partially cut away elevation view of the female ferrule showing in the cut-away portion a cross-section of the nipple and dielectric covering of the conductor.

FIG. 5 discloses details of the female ferrule 42, the base 56 of which is passed over the dielectric covering 36 of the conductor 46. When the electrically conductive rod is segmented, the end of the conductor 46 is attached to a first nipple 58, over which first nipple 58 the female ferrule 42 is closely fitted to establish reliable electrical contact between the conductor 46 and ferrule 42, to hold the female ferrule 42 firmly in place, and for ease and efficiency of manufacturing assembly.

Figure 6:
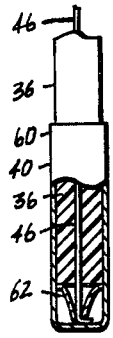
FIG. 6 is an enlarged partially cut away elevation view of the male ferrule showing in the cut-away portion a cross-section of the nipple and dielectric covering of the conductor.

In similar manner, FIG. 6 provides details of the male ferrule 40, the base 60 of which is passed over the dielectric covering 36 of the conductor 46. The end of the conductor 46 is attached to a second nipple 62, over which second nipple 62 the male ferrule 40 is closely fitted to establish reliable electrical contact between the conductor 46 and ferrule 40, to hold the male ferrule 40 firmly in place, and for ease and efficiency of manufacturing assembly.

Figure 7:
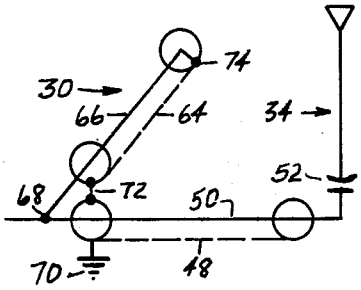
FIG. 7 is a circuit diagram of the preferred embodiment tuning means in conjunction with the wire for attaching the electrically conductive rod to a transceiver.

FIG. 7 is a circuit diagram showing the preferred embodiment of the tuning means. It comprises a tuning stub from coaxially shielded 64 cable 66, which may be of the same construction as the wire 18 for removably attaching the rod 34 to a transceiver 20 (shown only in FIG. 1) such as with the typical PL 259 connector 28 (shown in FIG. 2) located at or near 68. The cable 66 is an electrical contact at 68 with the cable 50 leading from the rod 34 through the resonating capacitor 52. The cable 50 is also shielded 48 and the shielding 48 is grounded at 70. The grounded shielding 48 is electrically connected at 72 to the shielding 64 of the tuning means 30, grounding it also.

Tuning of invention is accomplished at manufacturing assembly by utilizing a voltage standing wave ratio (SWR) meter (not shown) temporarily connected in series between the transceiver 20 and the wire 18 to trim the tuning stub to the appropriate length that will optimize the SWR. After that determination has been made, the SWR meter is removed and the cable 66 is electrically connected to the shielding 64 at 74. In this matter, the invention requires no ground plane and can be portably employed anywhere.

Figure 8:
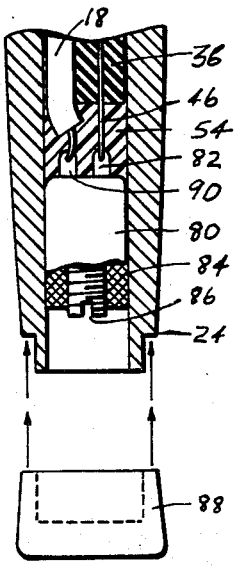
FIG. 8 is an enlarged broken cross-sectional view through a diameter of the base in an alternative embodiment for adjustable tuning means located in the base.

An alternative embodiment of this tuning means is disclosed in FIG. 8. In this embodiment, tuning means 30 is moved to a location in the hollow base 24 at the other end of the wire 18. In this embodiment, the tuning means is a hollow cylindrically wound tuning coil 80 having internal threads and two terminals. Stopper 56 (shown only in FIG. 3) and resonating capacitor 52 are eliminated. The conductor 46 protrudes from dielectric 36a (shown only in cross-section), is immersed in sealant 54, and is attached to a terminal 82 of the tuning coil 80 which has internal threads. The coil includes an adjustable externally threaded metallic tuning slug 84 having a screw driver slot 86 therein for adjustment when the removable butt cap 88 is taken off the bottom of the hollow base 24. In this manner, the invention may be retuned by turning the threaded tuning slug 84 at any time. Another terminal 90 is connected to the means 18 for attaching the invention to a transceiver.

While the present invention has been principally described in connection with a segmented construction of the electrically conductive rod which is preferable, it will be evident that it can be similarly constructed utilizing a one piece rod without a coupling when the length of antenna is appropriate, when the antenna can be shortened with loading coils, when sacrifice in performance is acceptable, and the like.

It will be similarly evident from the foregoing that substantial advantages accrue from the invention. These include a truly portable multiple application pretuned transceiver antenna that can utilize pre-existing hardware on boats, beach buggies and the like, yet be suitable for campsite and hand held use, and may still be readily disassembled for convenient storage. The invention may include at least one coupling providing simple but reliable electrical contact with a low cost design for ease and economy of manufacturing.

When employed, this reliable but low cost coupling generates or enhances a number of additional advantages for the invention, including convenient storage, yet the length and height in use for maximum radio range. The storage capability and the invention's portability serve to permit greater utilization, protect the antenna from theft, corrosion and weathering, keep the antenna out of the way when not needed, permit the antenna to be hand raised to maximum height only when needed. This also facilitates manual orientation when the antenna application is directionally sensitive or when it is used with a high gain transceiver on a supporting structure with unstable or improper orientation, such as a heeling sailboat, any boat rolling or pitching with swells, a beach buggy parked on the side of a sand dune, etc.

While the invention has been described in connection with a preferred and one or more alternative embodiments, it will be understood that there is no intention thereby to limit the invention. On the contrary, there is intended to be covered all alternatives, modifications and equivalents as may be included within the spirit and scope of the invention as defined by the appended claims, which are the sole definition of the invention.

I claim:

1. A portable transceiver antenna comprising:

a conductor embedded in a resilient dielectric covering thereby defining a rod which is divided into a plurality of completely separable segments having at least one coupling for electrical connection therebetween, said coupling including a male ferrule and female ferrule with each ferrule having a base passing over the dielectric covering and with each ferrule closely fitted over nipples in contact with the conductor thereby establishing reliable electrical contact through the coupling, holding the ferrules in place, and for ease and efficiency of manufacturing assembly;

a nonconductive base supporting the rod having a larger diameter than the rod and a friction inducing butt cap at its lowest extremity rendering the base suitable for retention by a conventional fishing rodholder, for hand held use and manual orientation;

a wire of coaxially shielded cable for removably attaching the rod to a transceiver; and a tuning stub connected to the wire.

2. A portable transceiver antenna comprising:

a conductor embedded in a resilient dielectric covering thereby defining a rod which is divided into a plurality of completely separable segments having at least one coupling for electrical connection therebetween, said coupling including a male ferrule and a female ferrule with each ferrule having a base passing over the dielectric covering and with each ferrule closely fitted over and in reliable electrical contact with nipples in electrical contact with the conductor, thereby establishing reliable electrical contact through the coupling, holding the ferrules in place, and for ease and efficiency of manufacturing assembly;

a nonconductive hollow base supporting the rod, having a larger diameter than the rod and a friction inducing butt cap at its lowest extremity rendering the base suitable for retention by a conventional fishing rodholder, for hand held use and manual orientation, said base further containing a resonating capacitor connected in series between the conductor and a wire, and sealant protectively immersing the contents of the base, said sealant limited by a stopper and a collar;

a wire of coaxially shielded cable for removably attaching the rod to a transceiver, said wire connected to the capacitor; and a tuning stub connected to the wire.

3. A portable transceiver antenna comprising: a conductor embedded in a resilient dielectric covering thereby defining a rod which is divided into a plurality of completely separable segments having at least one coupling for electrical connection therebetween, said coupling including a male ferrule and female ferrule with each ferrule having a base passing over the dielectric covering and with each ferrule closely fitted over and in reliable electrical contact with nipples in electrical contact with the conductor;

a nonconductive base supporting the rod and suitable for hand held use, manual orientation and retention by a conventional fishing rodholder;

a wire of coaxially shielded cable for removably attaching the rod to a transceiver; and tuning means connected to the wire.

4. The portable transceiver antenna of claim 3 wherein the resilient dielectric covering is comprised of fiberglass.

5. The portable transceiver antenna of claim 3 wherein the tuning means is comprised of another coaxially shielded cable having a first end of its coaxial shielding connected to the coaxial shielding of the wire, having a first end of its cable connected to the cable of the wire, and having a second end of its cable connected to a second end of its shielding.

6. The portable transceiver antenna of claim 3, wherein the tuning means comprises a hollow cylindrically wound coil having internal threads and two terminals, the first of which is connected to the conductor and the second of which is connected to the cable of the wire; and an externally threaded metallic slug having a screwdriver slot therein.

7. The portable transceiver antenna of claim 3 wherein the base comprises a member of greater diameter than the electrically conductive rod and includes at its lowest extremity a friction inducing butt cap.

8. The portable transceiver antenna of claim 3 wherein the nonconductive base is hollow; the tuning means is a tuning stub; a resonating capacitor is connected in series between the conductor and the wire within the hollow base; and the capacitor and connections between conductor and capacitor, and between capacitor and wire are all protectively immersed during assembly of the invention in a sealant within the hollow base, said sealant limited by a stopper and a collar.

* * * * *